US005688145A

United States Patent [19]

Liu

[11] Patent Number: 5,688,145

[45] Date of Patent: Nov. 18, 1997

[54] ADAPTER SOCKET STRUCTURE AND METHOD FOR FORMING SAME

[75] Inventor: Danny Liu, Taipei, Taiwan

[73] Assignee: Dan Chief Enterprise Co., Ltd., Taipei, Taiwan

[21] Appl. No.: 593,662

[22] Filed: Jan. 29, 1996

[51] Int. Cl.[6] ..... H01R 13/648

[52] U.S. Cl. ..... 439/607; 439/610

[58] Field of Search ..... 439/607, 609, 439/610, 626, 395, 403, 405, 76, 79

[56] References Cited

U.S. PATENT DOCUMENTS 5,087,210 2/1992 Myers et al. ..... 439/676 X 5,199,891 4/1993 Reed ..... 439/610 X 5,518,423 5/1996 Green et al. ..... 439/610

*Primary Examiner*—Khiem Nguyen

*Attorney, Agent, or Firm*—Madson & Metcalf

[57] ABSTRACT

An adapter socket structure and a method for manufacturing the same are disclosed. The adapter socket structure can effectively prevent the external electromagnetic interference effect. The structure includes a signal-transmitting interface device for providing an interface between two networks; and a metal case tightly enveloping the signal-transmitting interface device for preventing the interference of the external noise and reducing the radiation leakage of the transmitted signal, the metal case comprising a first case member and a second case member.

8 Claims, 2 Drawing Sheets

ADAPTER SOCKET STRUCTURE AND METHOD FOR FORMING SAME

FIELD OF THE INVENTION

The present invention relates to an adapter socket structure and its manufacturing method thereof. More particularly, the present invention relates to an adapter socket structure free from electromagnetic interference (EMI). It will be recognized that the present invention has a wider range of applicability. Merely by way of example, the invention may be applied in telecommunication networks, computer networks, among others.

BACKGROUND OF THE INVENTION

Industry utilizes or has proposed various adapter sockets in different applications such as telephone switch machines, communication networks, wall sockets, etc. Especially for network communication, adapter sockets are used in large quantities.

Generally speaking, one of the major problems for adapter sockets used in network communication is the interface problem. In fact, there are various adapter sockets developed for solving this problem. Global competition is driving in the need for telecommunication capacities. Corresponding to the advance in the computer technology, the data transmitted on the network are tremendously increased and the transmission speed requires also increased. Therefore, the network is apt to be interfered by external noises, or the mutual interference between networks, thereby resulting in the loss of the data, the malfunction of the computers, the disorder of the networks, among others.

For preventing the electromagnetic interference, the metal case is used to envelop the adapter socket. Whereas, the conventional metal case is not integrally-formed and thus does not tightly shelter or shield the adapter socket, so there are still slits, openings or slots existing between the case junctions. After the electrical test, the EMI-preventing effect thereof is not satisfactory. In addition, this conventional adapter socket is not convenient for use. Further, the manufacturing and assembling are still complicated, thereby increasing the manufacturing cost.

From the above it is seen that a cost-effective adapter socket free from the electromagnetic interference effect, and capable of being used conveniently and easily manufactured and assembled is often desired.

SUMMARY OF THE INVENTION

One object of the present invention is to provide an adapter socket which can effectively solve the electromagnetic interference problem.

Another object of the present invention is to provide an adapter socket which can be conveniently used.

Yet another object of the present invention is to provide an adapter socket which can be easily manufactured and assembled.

A further object of the present invention is to provide a cost effective adapter socket.

In a specific embodiment, the present invention provides a method for manufacturing an adapter socket structure comprising steps of: (a) providing an adapter socket; (b) providing a communication wire; (c) passing the communication wire through the adapter socket; (d) providing an integrally-formed metal case, the metal case comprising a first case member and a second case member; and (e) enveloping tightly the adapter socket with the metal case, the first case member and the second case member being engaged with the adapter socket.

Certainly, the adapter socket can include a molded receptacle comprising a molded receptacle body and a metal receptacle front case connected to the molded receptacle body; a set of terminals installed in the molded receptacle; and a circuit board for electrically connecting the terminals with the wire.

Certainly, the communication wire can further include a metal net exposed near the end of said wire; a metal ring surrounding the metal net; and a hook member on the metal ring for lockingly engaged with the adapter socket.

Certainly, the second member can further include a second case member opening for allowing the metal receptacle front case extending therefrom after the adapter socket is enveloped by the metal case.

Certainly, the first case member further includes a first case member indentation for engaging therein the metal ring after the adapter socket is enveloped by the metal case.

In an alternative embodiment, the present invention provides an adapter socket structure. The adapter socket structure includes a signal-transmitting interface device for providing an interface between two networks; and a metal case tightly enveloping the signal-transmitting interface for preventing the interference of the external noise and reducing the radiation leakage of the transmitted signal, the metal case comprising a first case member and a second case member.

Certainly, the signal-transmitting interface device can include a molded receptacle comprising a molded receptacle body and a metal receptacle front case connected to the molded receptacle body; a set of terminals installed in the molded receptacle; and a circuit board for electrically connecting the terminals with the communication wire.

Certainly, the first case member can include a first case member indentation for allowing an external wire to pass therethrough. The external wire can expose near the end thereof a metal net and the metal net can be surrounded by a metal ring for lockingly and tightly engaging in the first case member indentation. The metal ring can further include a hook member for lockingly engaging with the adapter socket body. The second case member can further include a second case member opening for permitting the receptacle to extend therefrom after the adapter socket is enveloped by the metal case. The second case member opening can be lockingly and tightly engaged with the metal receptacle front case. The first and second case members can be of cubical ones. The present invention may best be understood through the following description with reference to the accompanying drawings, in which:

DETAILED DESCRIPTION OF THE PREFERRED EMBODIMENT

Figure 1:
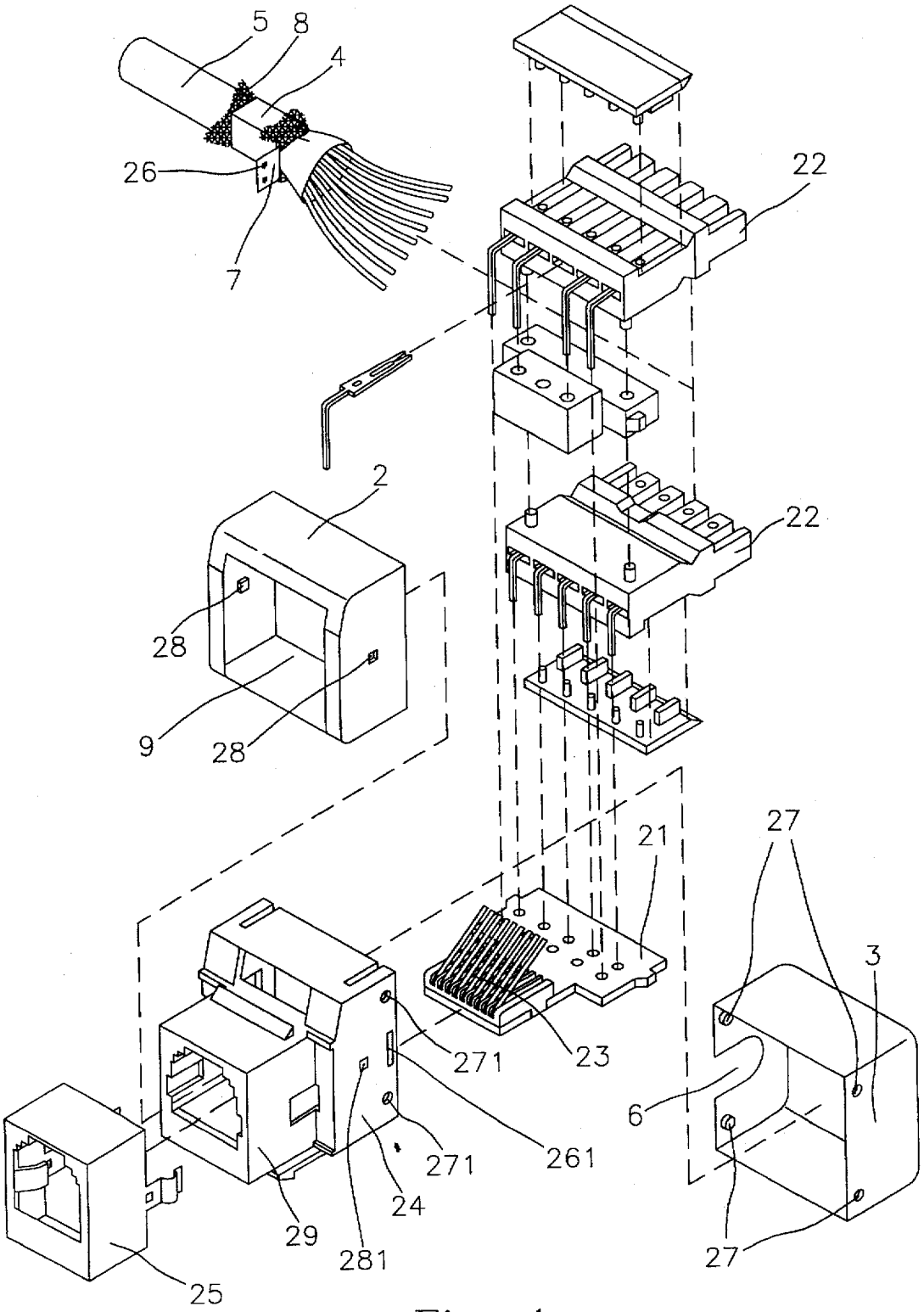
FIG. 1 illustrates a dismantled perspective view of one preferred embodiment of an adapter socket structure according to the present invention.

FIG. 1 illustrates one preferred embodiment of an adapter socket structure according to the present invention. The structure generally includes a signal-transmitting interface device 1 (i.e., the adapter socket) for providing an interface between two networks; and a metal case tightly enveloping the signal-transmitting interface device 1 for preventing the interference of the external noise and reducing the radiation leakage of the transmitted signal. The metal case includes a first case member 3 and a second case member 2 to be engaged to signal-transmitting interface device 1. The first case member 3 has a first case member indentation 6. A communication wire 5 and a metal ring 4 are also shown in FIG. 1.

Figure 2:
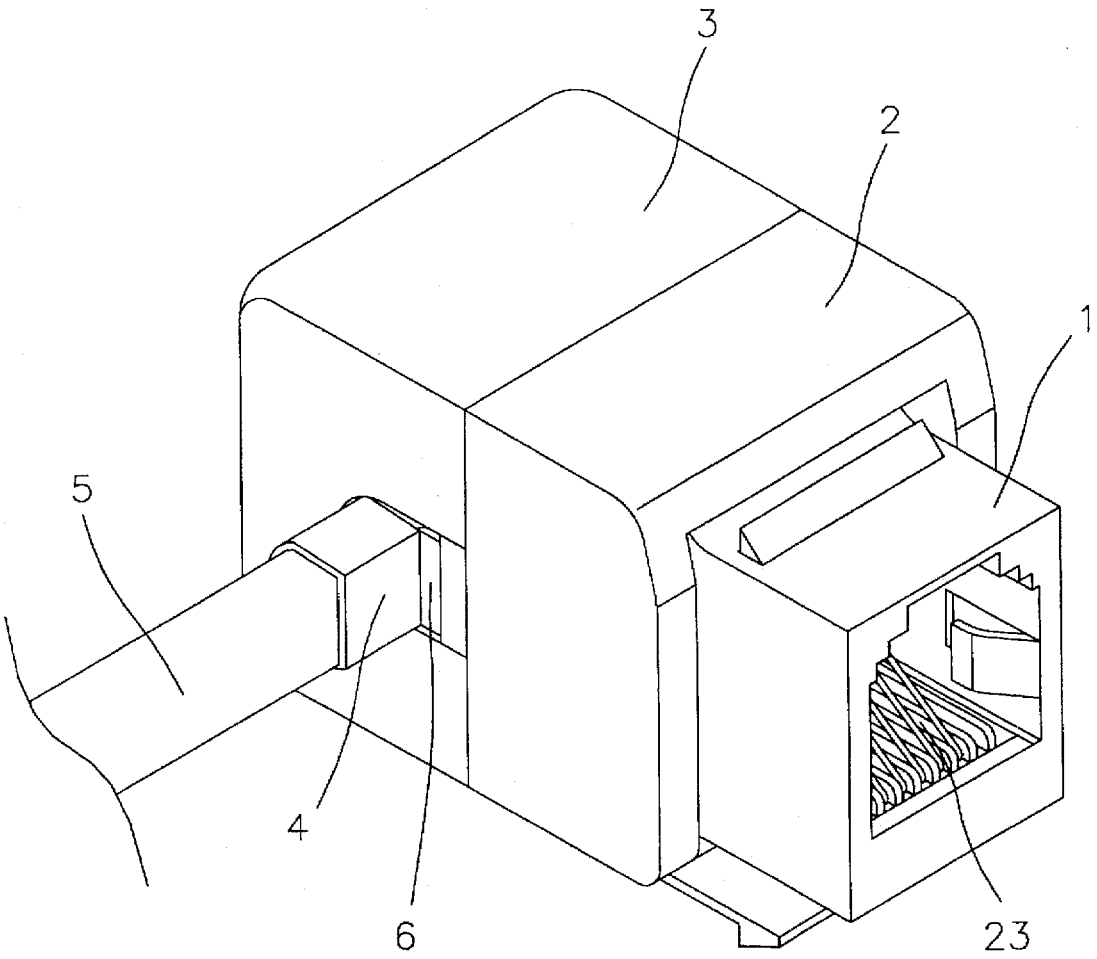
FIG. 2 illustrates a perspective view of one preferred embodiment of an adapter socket structure according to the present invention.

FIG. 1 illustrates a dismantled perspective view of one preferred embodiment of the adapter socket structure according to the present invention. The adapter socket 1 comprises a molded receptacle 29, IDCs (Insulation Displacement Connectors) 22, a circuit board 21, and contact terminals 23. The IDCs 22 are inserted and soldered on the circuit board 21. The molded receptacle 29 comprises a molded receptacle body 24 and a metal receptacle front case 25. The circuit board 21 electrically connects thereto the contact terminals 23 and is secured in the molded receptacle body 24. The molded receptacle body 24 is generally integrally formed with the metal receptacle front case 25. The case members 2, 3 are integrally-formed and manufactured respectively by extruding and can be matched with other. The shapes of the first case member 3 and the second case member 2 are manufactured in order to match with or accommodate those of the molded receptacle body 24 and the IDCs 22. In the embodiment of FIGS. 1 and 2, the second case member 2 is an open cubical one and has a second case member opening 9. The first case member 3 is also an open cubical one and has the first case member indentation 6. The first case member indentation 6 allows the external wire 5 to pass therethrough.

The wire 5 is connected to the IDCs 22. The external wire 5 exposes near the end thereof a metal net 8. A metal ring 4 is installed around the metal net 8. The metal net 8 discharges the static electricity due to the tight connection of the metal ring 4 in the indentation 6 of the first case member 3. The metal ring 4 further includes a hook member 7 having protrusions 26. The molded receptacle body 24 has an openings 261. By causing the metal ring protrusions 26 to be engaged in the openings 261, the external wire 5 is thereby tightly fixed. The second case member opening 9 allows part of the adapter socket 1 (i.e., the metal receptacle front case 25) to extend therefrom after the adapter socket 1 is enveloped by the metal case. The metal receptacle front case 25 and the second case member 2 are tightly interengaged for obtaining a completely EMI-preventing effect.

The first case member 3 has plural protrusions 27 for lockingly engaging in openings 271 of the molded receptacle body 24. The second case member 2 also has plural protrusions 28 for lockingly engaging in openings 281 of the molded receptacle body 24. The protrusions 27 and 28 are located on the inside of their respective walls. Therefore, the first case member 3 and the second case member 2 can tightly envelop around the molded receptacle body 24.

Additionally, the present invention provides a method for manufacturing an adapter socket structure. The method includes the steps of:

(a) providing an adapter socket 1;
(b) providing a communication wire 5;
(c) passing the communication wire 5 through the adapter socket 1;
(d) providing an integrally-formed metal case, the metal case comprising a first case member 3 and a second case member 2; and
(e) enveloping tightly the adapter socket 1 with the metal case, the first case member 3 and the second case member 2 being lockingly engaged to adapter socket 1.

The adapter socket 1 includes a molded receptacle 29 having a molded receptacle body 24 and a metal receptacle front case 25 connected to the molded receptacle body 24; a set of terminals 23 installed in the molded receptacle 29; and a circuit board 21 for electrically connecting the terminals 23 with the wire 5.

The second member 2 includes a second case member opening 9 for allowing the metal receptacle front case 25 to extend therefrom after the adapter socket 1 is enveloped by the metal case. The communication wire 5 includes a metal net 8 exposed near the end thereof; a metal ring 4 surrounding the metal net 8 for being lockingly engaged in the first case member indentation 6; and a hook member 7 on the metal ring 4 for lockingly engaged with the adapter socket 1.

The first case member 3 further includes a first case member indentation 6 for lockingly engaging therein the metal ring 4 after the adapter socket 1 is enveloped by the metal case.

To sum up, the present invention provides an adapter socket structure which can effectively prevent the EMI effect. That is, the interference of the external noise and the radiation leakage of the transmitted signal can be prevented according to the present invention. Further, the present adapter socket structure can also be used conveniently and manufactured and assembled easily. While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. For example, while the description above is in terms of telecommunication adapter sockets, it would be possible to implement the present invention with other apparatus such as telephone switch machines, computer networks, among others.

Therefore, the above description and illustration should not be taken as limiting the scope of the present invention which is defined by the appended claims.

What is claimed is:

1. An adapter socket structure, comprising:

an adapter socket for providing an interface between two electrical apparatuses which includes:

a molded receptacle comprising a molded receptacle body and a metal receptacle front case connected to said molded receptacle body;

a set of terminals installed in said molded receptacle; and a circuit board electrically connected with said terminals; and a first metal case member and a second metal case member for enveloping said adapter socket, wherein each of said first metal case member and second metal case member is integrally formed by extruding so that there is no slit thereon for preventing an interference of an external noise and reducing a radiation leakage of a transmitted signal.

2. An adapter socket structure as set forth in claim 1 wherein said first metal case member includes a slot for allowing an external cable to pass therethrough.

3. An adapter socket structure as set forth in claim 2 wherein a metal net at one end of said external cable is exposed and surrounded by a metal ring for being tightly engaged in said slot.

4. An adapter socket structure as set forth in claim 3 wherein said metal ring further comprises a hook member for being engaged with said adapter socket.

5. An adapter socket structure as set forth in claim 1 wherein said second metal case member further comprises an opening for permitting said receptacle to extend therethrough.

6. An adapter socket structure as set forth in claim 1 wherein each of said first metal case member and said second metal case member is an open cubic case.

7. An adapter socket structure as set forth in claim 1 wherein each of said two electrical apparatuses is an electrical network.

8. A method for forming an adapter socket structure comprising the steps of:

(a) providing an adapter socket;

(b) providing a communication cable;

(c) passing said communication cable through said adapter socket;

(d) providing a first metal case member and a second metal case member integrally formed by extruding; and (e) enveloping tightly said adapter socket with said first metal case member and said second metal case member.

* * * * *